United States Patent [19]

Weber

[11] 4,209,911

[45] Jul. 1, 1980

[54] METHOD AND APPARATUS FOR DRYING A MOISTURE-CONTAINING PARTICULATE MATERIAL

[75] Inventor: Carl L. Weber, Pipersville, Pa.

[73] Assignee: Hydrocarbon Research, Inc., Lawrenceville, N.J.

[21] Appl. No.: 945,026

[22] Filed: Sep. 22, 1978

[51] Int. Cl.[2] ..... F26B 3/00

[52] U.S. Cl. ..... 34/9; 34/12; 34/60

[58] Field of Search ..... 34/9, 60, 61, 12

[56] References Cited

U.S. PATENT DOCUMENTS

| | | | |
|---|---|---|---|
| 3,188,196 | 6/1965 | Skelly | 34/9 |
| 3,520,067 | 7/1970 | Winegartner | 34/9 |
| 3,953,927 | 5/1976 | Hoffert | 34/9 |

*Primary Examiner*—John J. Camby
*Attorney, Agent, or Firm*—Michael A. Jacobs

[57] ABSTRACT

This invention relates to a process and apparatus for drying moisture-containing particulate materials. The process comprises feeding the particulates to a drying vessel containing therein a hydrocarbon liquid maintained at a temperature sufficiently high to rapidly evaporate the moisture; stirring the articulate-liquid slurry in the vessel so as to maintain particle flow therein; feeding a hot hydrocarbon liquid to the vessel; heating the vessel wall above the liquid level to a temperature above the slurry temperature to prevent foaming; removing from the vessel an overhead vapor product; and condensing the vapor product to recover water and hydrocarbon liquid. An apparatus useful for carrying out the above-mentioned process is also claimed.

20 Claims, 5 Drawing Figures

METHOD AND APPARATUS FOR DRYING A MOISTURE-CONTAINING PARTICULATE MATERIAL

BACKGROUND OF THE INVENTION

1. Field of the Invention

This invention relates to a process and apparatus for drying moisture-containing particulate materials in a hot hydrocarbon liquid. More particularly, this invention provides a method and apparatus for drying wet ground coal in a hot hydrocarbon oil whereby the foaming of the coal-oil slurry is minimized.

2. Prior Art

In coal hydro liquefaction processes the moisture content of ground coal must be reduced to less than about 4 percent by weight before it is fed to the liquefaction reactor. In many state of the art liquefaction processes for example, ebullated bed processes, described in U.S. Pat. No. Re 25,770, it is necessary to slurry particulate coal with a liquid hydrocarbon prior to passage to the reaction zone. However, moisture contents greater than about 4 weight percent will usually produce some foaming in the slurry mixing tank and such foam will evolve at temperatures above about 220° F. and foul the coal heating system as well as interfere with the smooth operation thereof. Therefore, it is desirable to remove as much of the moisture content in wet ground coal prior to passage to the liquefaction reactor.

The drying of high moisture-containing coal particulates by heating the particulates in a coal-oil slurry is well known. One such method is disclosed in U.S. Pat. No. 3,520,067 wherein wet ground coal is dried in a heated hydrocarbon oil maintained in a pressurized vessel. The water vapor liberated is withdrawn from the upper portion of the vessel as an overhead product. The moisture-containing particulates are introduced adjacent to, but below, the surface of the drying oil to minimize foaming and particle entrainment in the vapor products. This process does not provide any means for breaking the foam generated by the drying step.

Another prior art method for drying coal is disclosed in U.S. Pat. No. 3,680,217. According to this method, ground coal is dried prior to using in a coal hydrogenation liquefaction process and a heated slurry medium derived from the liquefaction process. The slurry containing the dried coal particulates is concentrated and used directly in the liquefaction process. However, since no means is provided for maintaining a well mixed slurry the coal will tend to settle out. In addition, this invention provides no means for controlling foaming.

A further prior art method is disclosed in U.S. Pat. No. 3,953,927, the disclosure of which is incorporated by reference, wherein coal particulates are dried by heating the coal in an oil slurry contained in a pressurized drying zone so as to vaporize the moisture. A principal portion of the heat utilized in the drying zone is provided by compressing the hot steam evolved from the coal drying zone and condensing it in the heat exchanger within the drying zone. This process suffers from the disadvantage that the evolution of moisture usually causes foaming and results in the formation of agglomerated coal particulates on the surface of the slurry which can clog the system unless sufficient mixing is provided. In addition, the coal particulates may be undesirably carried out of the vessel when they become entrained by the liberated water vapor.

The inventor has found that by means of the invention described herein, substantially all of the moisture content in wet ground coal may be removed without the disadvantages of the prior art.

It has also been discovered that by using the present invention, foaming in the hydrocarbon liquid is substantially reduced. Foaming is undesirable since it limits the rapid escape of water vapor from the hot slurry into the vapor stream. Furthermore, moisture may be entrapped in the foam so as to prevent complete drying of the coal particulates.

SUMMARY OF THE INVENTION

The invention provides a method and apparatus for drying moisture-containing particulates. The process comprises maintaining a volume of hydrocarbon liquid at a temperature of from about 220° to about 550° F. in a drying vessel; feeding the particulates to the vessel at a point above the liquid level; stirring the particulate-liquid slurry; feeding a stream of hydrocarbon liquid above the particulate feed so as to prevent entrainment of same in the vapor phases above the liquid level and to wash the particulates into the liquid in the vessel; heating the vessel wall to prevent foaming; withdrawing from the vessel a bottom product comprising hydrocarbon liquid and substantially dried particulates; and withdrawing and condensing the vapor as an overhead product to recover water and hydrocarbon liquid.

This invention is particularly useful in drying wet, ground coal which, after being dried to a desired low moisture content, can be fed in slurry form directly to a hydrogenation liquefaction reaction zone in a coal liquefaction process. The moisture in the coal is evaporated rapidly by the hot hydrocarbon liquid. Any foam which is formed above the slurry liquid surface by the evaporating moisture is controlled by suitable foam breaking means.

DETAILED DESCRIPTION OF THE INVENTION

Figure 1:
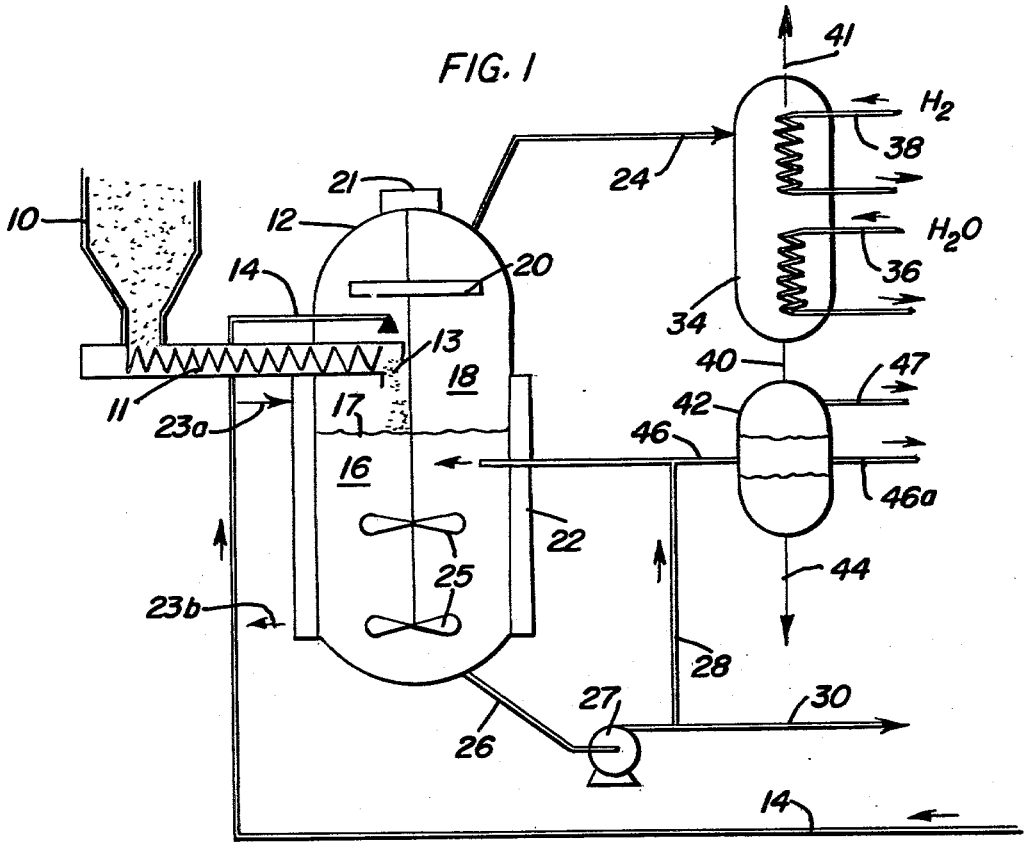
FIG. 1 shows a preferred embodiment of the invention.

The present invention is described as follows, with coal containing 5 to 30 weight percent moisture being the particulate material to be dried. However, one skilled in the art will recognize that the invention is applicable to any moisture-containing solid which does not react with the hydrocarbon liquid, such as lignite or other solid carbonaceous material.

The moisture-containing coal is first ground to a particle size smaller than about ¼ inch, preferably to less than about 8 mesh, and most preferably less than 40 mesh (U.S. Sieve Series). The coal is then fed to a volume of hydrocarbon liquid, such as oil, contained in a vessel, which liquid is maintained at a sufficiently high temperature to vaporize the moisture. A suitable oil temperature is at least 220° F. and up to about 550° F., preferably between about 250° to 450° F. The drying vessel is divided into a drying zone and a vapor zone. The drying zone comprises the lower portion of the vessel wherein the hydrocarbon liquid is stored. The portion of the vessel above the liquid surface forms the vapor zone. The coal is fed to the vessel above the liquid level. Generally, the moisture will be removed by maintaining an average residence time for the coal of less than about 30 minutes, preferably between about 2 to about 20 minutes.

As moisture evolves from the coal, a layer of foam is usually formed on the liquid surface. The presence of this foam layer is undesirable, since it limits the escape of water vapor from the slurry into the vapor zone and it entraps moisture so to interfere with complete drying of the coal. Thus, it is of primary importance that the layer of foam be prevented from forming. To retard foam, a suitable foam breaking means is provided in the vapor zone. Examples of useful foam breaking means include a heated vessel surface above the liquid level as well as a mechanical means such as a rotating vane.

To further minimize foaming, a stream of hot hydrocarbon liquid is fed tangentially to the vessel below the liquid surface so as to effect a downward spiral flow in the liquid along the interior wall of the vessel. This vortical flow of the liquid facilitates the mixing of the coal and liquid so as to reduce foaming. In addition, the vortical flow may be increased by stirring the liquid with a propeller-type mixture means.

As an additional means to reduce foaming, the walls of the drying vessel are heated to a temperature sufficient to break any foam that forms above the liquid, at least equal to slurry liquid temperature and preferably 250° to 500° F. The heated walls also prevent the water vapor from condensing in the drying zone.

As mentioned above, the coal is introduced into the vessel at a point above the liquid level so that the falling particulates can assist in breaking any foam formed. In order to prevent the fine particulates from being carried out of the vessel by the overhead vapor product, a stream of hydrocarbon liquid is sprayed over the particulate feed to wash same into the liquid in the vessel. The hydrocarbon liquid should have a normal boiling temperature above about 500° F. and preferably 550° to 950° F.

The vapor zone in the vessel is about ¼ to ½ the length of the drying zone, and the weight ratio of coal to hydrocarbon liquid in the drying zone is from about 1:1 to about 1:3. For drying vessels having a diameter greater than 3 feet, at least one rotating vane is provided above the liquid introduction point. It is noted that the greater the amount of coal in the coal-liquid slurry, the greater is the amount of foam produced.

A slurry containing the substantially dried coal is removed from the drying vessel as a bottoms product. The water, as well as some hydrocarbon vapor, is withdrawn as an overhead product and condensed. A portion of the bottoms product may be recycled to the drying zone and fed tangentially to the vessel as the stream of hot hydrocarbon liquid mentioned above. Alternatively, a second portion of the bottoms product may be recycled and sprayed onto the particulate feed. As another alternative, a hydrocarbon liquid from a coal liquefaction process having the proper temperature and boiling range may be used to spray the particulate feed.

The bottoms slurry product which contains the dried particulates may be fed to a separator wherein the particulates are separated from the slurrying liquid, which may then be recycled to the drying vessel. However, the bottoms product preferably may be pumped to a reaction zone in a coal liquefaction process and used as a reactant. Such a liquefaction process is disclosed in U.S. Pat. No. Re 25,770, the disclosure of which is incorporated herein. While the bottoms product can be used as the feed stream for a liquefaction process, which converts solid carbonaceous matter by contacting same in a hydrocarbon oil slurry, it is most useful in the ebullated bed catalytic hydrogenation process described in U.S. Pat. No. Re 25,770.

The dried particulates usually contain from about 0.1 to about 5 weight percent moisture, preferably from about 1 to about 4 weight percent. The vapor product from the drying step is condensed, with the water being drained away and the hydrocarbon liquid recycled to the drying vessel or fed to the coal liquefaction zone. However, since the condensed hydrocarbon liquid usually comprises a light oil (low boiling point), preferably only a minor portion thereof is recycled to the drying vessel. While any convenient cooling medium such as cooling water may be used, it is preferred to employ the cold make-up hydrogen stream required for the hydrogenation reactor as a cooling stream.

PREFERRED EMBODIMENTS OF THE INVENTION

With reference to FIG. 1, wet particulate coal, stored in hopper 10 and having a moisture content of greater than 4 weight percent and generally between about 5–30 weight percent, is introduced by conveyor means 11 into the drying zone in vessel 12 at location 13. The coal has a particle diameter of less than ¼ inch, preferably 8–350 mesh, U.S. Sieve Series. Any hydrocarbon liquid derived from the process, such as heavy oil, is introduced under pressure to the drying zone at 14 to form a volume of slurrying oil 16. The hydrocarbon liquid should have a boiling temperature of above 500° F., preferably from about 600° to 850° F., and should generally boil at a temperature such that the hydrocarbon liquid will not vaporize. The space above the slurry surface defines vapor or foam dissipation zone 18. Slurry oil stream 14 is at a sufficiently high temperature to heat the volume of coal-oil slurry 16 to at least 220° F., preferably to about 250°–550° F., and more preferably to about 300°–400° F. The walls of vessel 12 are heated by supplying steam or some other heating medium to jacket 22. Under these conditions, a major portion of the moisture in the coal is evaporated relatively rapidly from surface 17 of the liquid. The slurrying oil is introduced at 14 above coal feed 13, so as to entrain or wash the coal into liquid body 16 and prevent the transportation of the coal fines out of the vessel by the evolved vapor. Any foam which is produced above the liquid in foam dissipation space 18 is substantially broken up and destroyed by hot surface 19 or mechanical foam breaking means such as rotating vane 20 operated by drive means 22. Vane 20 is preferably provided with a blade inclined from the vertical plane by an angle between about 5 to 80 degrees, so as to provide a downward force against the rising foam.

The resultant effluent vapor containing mostly water, along with some oil vapor, is then withdrawn as stream 24. It is noted that the upward vapor velocity, above liquid surface 17 should not exceed 0.3 ft/sec. preferably from about 0.1 to about 0.25 ft/sec, to avoid the carryover of coal fines in stream 24. The resulting dried coal-oil slurry liquid, having its moisture content reduced to below about 5 weight percent and preferably to about 1 to 4 weight percent, is withdrawn from the lower end of the dryer at 26. To maintain the coal particles suspended in the slurry oil, a plurality of mixing means 25 is provided in the lower liquid portion of the dryer and may be driven by motor 21. It is noted that mixing means 25 and foam breaking vane 20 may be mounted on the same shaft and driven by one motor. Slurry stream 26 is pressurized by pump 27. A portion 28 of stream 26 is recycled to the slurry body 16 and fed tangentially thereinto to promote mixing, as well as provide a vortical flow pattern therein. Such vortical flow is desirable since it prevents the settling of coal fines and provides a uniform slurry. As mentioned previously, the dried coal-oil slurry 28 can be further heated and fed as stream 30 in coal liquefaction processing, in accordance with U.S. Pat. No. 3,617,465 or any other coal liquefaction process utilizing particulate coal slurried in a hydrocarbon liquid.

In a preferred embodiment, the moisture contained in the coal is evaporated relatively rapidly from coal-oil slurry liquid 16, and after breaking any foam formed above the liquid surface 17, the vapor is withdrawn at 24. This vapor stream 24 may be cooled and condensed in heat exchanger 34 against a convenience cooler fluid, such as cooling water 36. Also, if desired, stream 24 may be cooled against the cold make-up hydrogen stream 38 for a coal liquefaction process. The resulting liquid condensate, which usually contains some oily material is removed at 40 and fed to separator 42, while noncondensables are removed at 41. The condensed water is removed from separator 42 as stream 44, and the oil portion is removed at 46, while any noncondensable gases are withdrawn at 47. The recovered light oil stream 46 may be recycled back to drying vessel 12, or alternatively a portion **46*a* may be added to a low pressure distillation step of a coal liquefaction process. Since the condensed light oil usually has a low boiling point, it is preferred to return only a minor portion thereof to vessel 12 as slurrying liquid 16**.

If desired, an auxiliary heating fluid passageway 22 may also be provided within the lower portion of liquid body 16 to supplement the heat input into the coal-oil slurry from stream 14. Such auxiliary heating fluid is preferably pressurized steam at **23*a*, and the resulting condensate is withdrawn at 23*b***.

The temperature of coal-oil slurry 16 should be at least about 220° F., preferably about 250° to 550° F., and more preferably from about 300° to 400° F., for best results in evaporating the moisture from the coal. The residence time of the coal in the liquid should be relatively short, less than about 25 minutes, preferably about 2 to 10 minutes. The slurry temperature should not be sufficiently high to devolatize the coal to any appreciable extent. Also, the pressure in the dryer vessel should be at least atmospheric and sufficient to restrict devolatilization of the coal, but may be up to about 15 psig. However, to simplify coal feeding, the pressure should preferably be from about 0.1 to 0.5 psig, more preferably about 0.2 psig.

Figure 2:
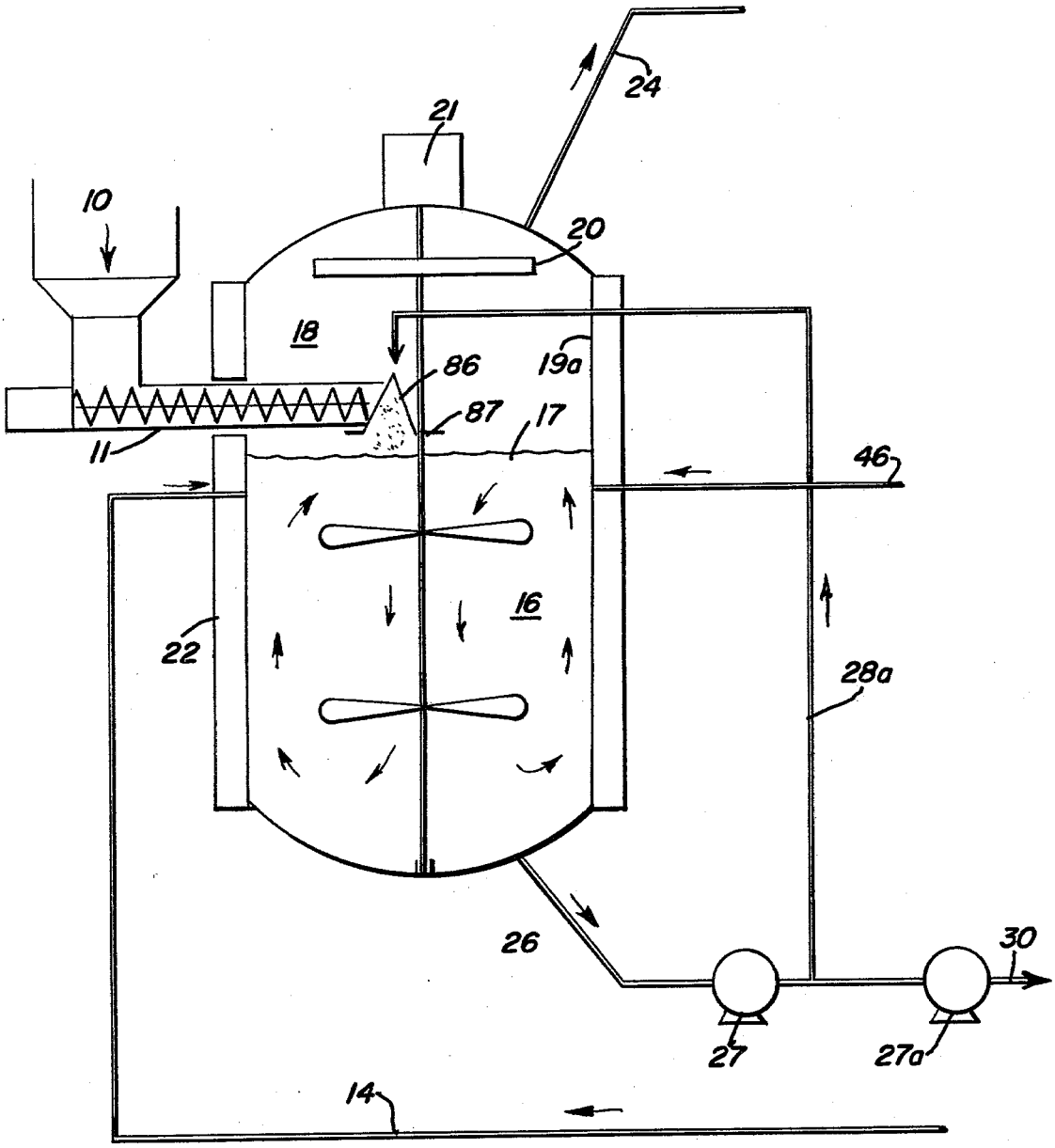
FIG. 2 shows a further preferred embodiment of the invention.

An alternative coal slurrying-drying process arrangement is shown in FIG. 2. This process is similar to that shown in FIG. 1, except that portion **28*a* of the dried coal slurry stream 26, instead of being fed to coal-oil slurry 16 below liquid surface 17, is fed into liquid distributor 86 located above coal feed point 13. This arrangement provides an effective means for the slurry oil to wash the particulate coal feed downwardly into coal-oil slurry 16**, and thus minimize any carryover of fine coal particles with the vapor stream.

Recirculated slurry stream **28*a* is directed against the pointed upper end of conical shaped distributor 86, having circumferential weir 87 projecting radially outward at its lower end. This distributor serves to provide a generally continuous curtain or film of falling liquid to shroud the particulate coal feed at 13 and thereby prevent carryover of coal fines with the evolved vapor in stream 24. The returned hot slurrying oil stream 14 a is introduced directly into liquid body 16**.

Because recycled liquid stream **28*a* can be increased to any desired extent, it can provide more effective coal washdown than returned slurrying liquid stream 14. Also, because stream 28*a* is fed at a lower temperature zone of the slurry liquid body 16, less hydrocarbon vapor will usually be generated and carried out of the drying vessel in effluent stream 24. For this arrangement, heated wall inner surface 19*a* can be advantageously extended the entire height of the vapor zone 18 to prevent water vapor condensation in vapor space 18** and facilitate foam breaking therein.

Figure 3:
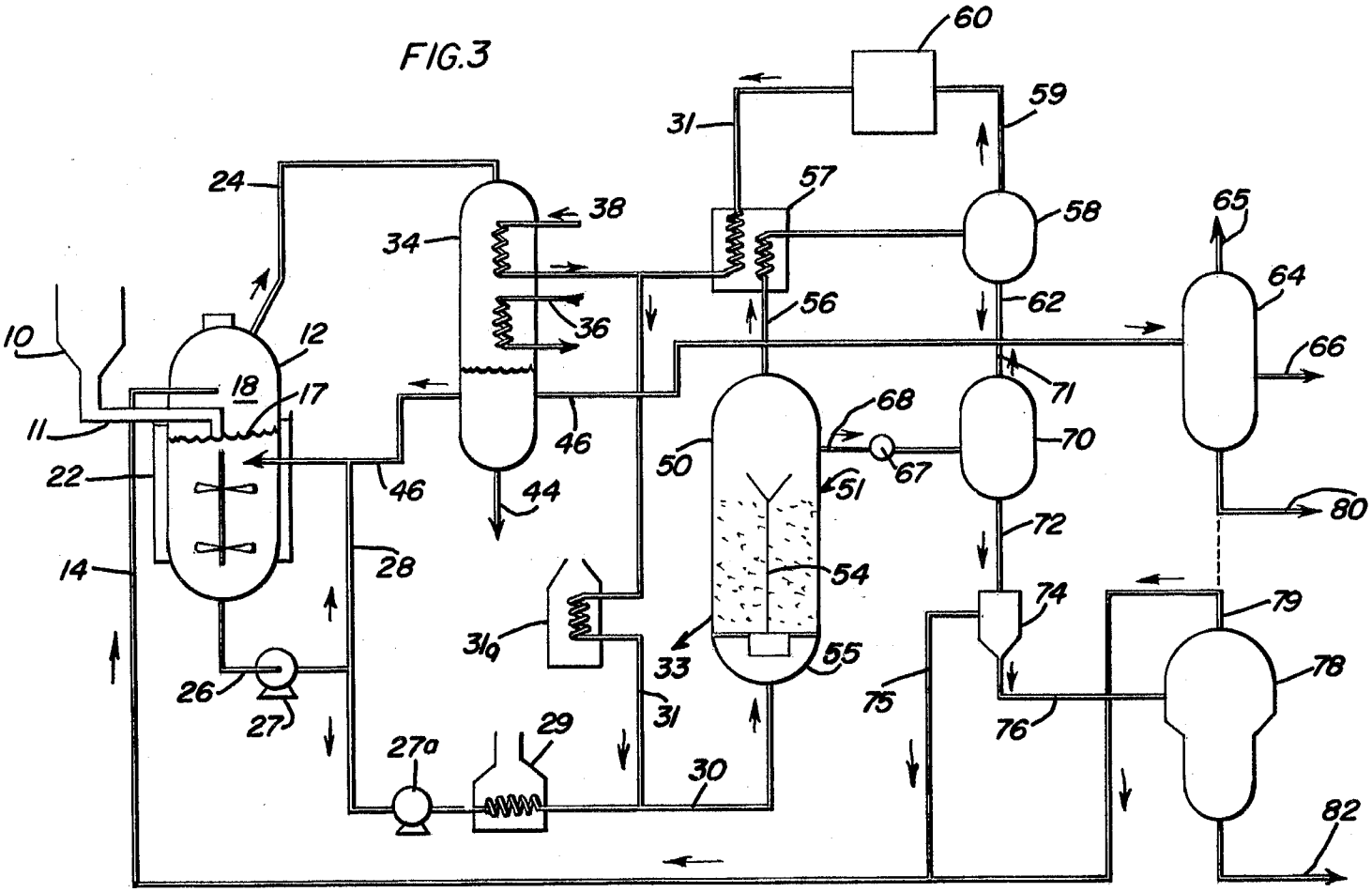
FIG. 3 shows the application of the invention to a coal liquefaction process.

As previously mentioned, the present coal drying-slurrying procedure can be advantageously utilized in a coal liquefaction process, preferably one utilizing an ebullating bed catalytic reaction step as shown in FIG. 3. In this process, the dried coal-oil slurry stream **28*b* is pressurized at pump 27*a*, further heated to about 600° F. at heater 29, and introduced along with heated hydrogen at 31 into ebullated bed reactor 50 containing catalyst bed 52. The coal passes upwardly from the bottom through the bed of particulate catalyst or inert solids at a rate and under sufficient pressure and temperature conditions to accomplish the desired hydrogenation. Fresh catalyst can be added at 51 and used catalyst removed at 53** as desired.

Preferred reactor operating conditions are in the range of 750° to 950° F. temperature and between 500 and 3000 psig hydrogen partial pressure. Coal throughput is at the rate of 15–300 pounds per hour per cubic foot of reactor space, and hydrogen circulation of 40,000–60,000 scfh per ton dry coal, with the liquid upward velocity on the order of 1 to 30 gallons per minute per square foot of horizontal cross-section of the reaction zone. Under these conditions, the yield of unreacted coal as char is less than about 10 percent of the quantity of moisture and ash-free coal feed.

In order to control at a desired level the reactor liquid upward velocity and the degree of catalyst bed expansion in reactor 50, part of the reactor liquid is usually recycled internally from above catalyst bed 52 through conduit 54 and pump 55 back into the lower end of the bed. Alternatively, an external liquid recycle arrangement (not shown) can be employed.

The overhead effluent stream 56, which is primarily gaseous and is virtually free of solid particles, is cooled at 57 and passes to high pressure separator 58. From separator 58, a gas stream 59 comprising principally hydrogen is removed, and after purification at 60 can be returned along with make-up hydrogen from 38 to reactor 50 as stream 31 to provide the hydrogen requirements therein. A liquid stream 62 from the separator 58 is passed to low pressure distillation step 64 for further recovery of gases and liquids.

The low pressure distillation at 64 permits removal of a high Btu heating value gaseous product at 65, a solids-free light oil product at 66, and a heavy distillate oil stream 80. Light oil stream 46a from condenser 42 associated with the coal slurrying-drying step is also passed to atmospheric distillation step 64 to provide part of light oil product at 66. If desired, a portion of the liquid from line 79 may be used to provide the coal slurrying oil at 14. However, it is generally preferred to use heavy oil as the slurrying oil since it has a high boiling point, which means that less oil vapor will be present in the overhead product in vessel 12.

Returning now to reactor 50, the degree of hydrogenation therein is such that the liquid stream withdrawn at 68 contains some ash and unconverted coal solids. Stream 68 is throttled at 67 and passes to low pressure separation system 70. From such a system a gaseous stream is removed at 71 and passed along with stream 62 to distillation step 64, and a flashed liquid stream removed at 72.

The bottoms liquid 72 withdrawn from separator 70 passes to solids separation system 74, which is preferably a hydroclone unit. The resulting low solids concentration overhead stream 75 is recycled via 14 to provide part of the slurrying oil at dryer 12. A high solids concentration stream is removed at 76 from separation system 74 and usually fed to a vacuum distillation step 78. This provides a vacuum gas oil stream at 79, most of which is recycled to provide a portion of the slurrying oil in line 14. However, if desired, a portion of bottoms residue stream containing unconverted coal (char) and ash with about 50 percent heavy oil is withdrawn through line 82 for disposal or further processing.

For this FIG. 3 embodiment, coal residence times in vessel 12 exceeding about 10 minutes are usually not needed to achieve adequate drying. However, for process control reasons, the coal residence times are usually longer, such as about 30–90 minutes, which results in substantially complete moisture removal from the coal even at moderate slurry liquid temperatures of 220°–250° F.

Figure 4:
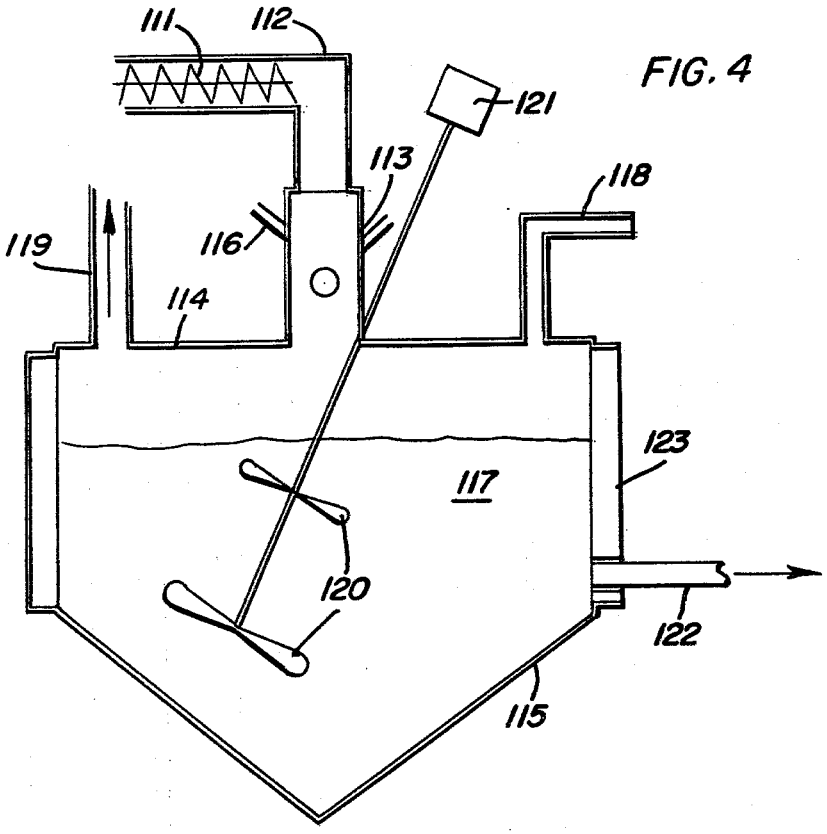
FIG. 4 shows another preferred embodiment of the invention.

FIG. 4 shows another preferred embodiment of this invention. Moisture-containing coal particulates are fed by means of screw-type conveyor 111 into conduit 112 which is connected to vertical conduit 113 in vessel 114. Vessel 114 is a cylindrical tank having a conical bottom portion 115. The ratio of the height of the conical portion to that of the cylindrical portion is approximately 1:2.5, although this ratio may be varied as required by the magnitude of the operation. As the coal falls through conduit 113 into vessel 114, a plurality of jets of a hot hydrocarbon liquid (such as oil) entering conduit 113 through downwardly pointing connecting conduits 116 is sprayed on the particulates so as to wash the coal into liquid 117. The jets of oil are maintained at a temperature of from about 250° to 550° F. Conduits 116 form an angle of from about 15 to about 75 degrees with conduit 113 and are disposed at equal distances along the circumference of conduit 113. While two to four of conduit 116 may be used, it is preferred to use three. Additional slurrying oil may be introduced to vessel 114 through conduit 118. Evaporated water and some oil vapor leave through outlet conduit 119. The slurry 117 is kept suspended by a plurality of agitating means 120 mounted on a rotary shaft and driven by motor 121. To obtain a high degree of mixing, it is preferred to tilt the agitating means 120 at an angle of from about 5 to 45 degrees from the vertical axis.

A slurry comprising oil and dried coal particulates leaves vessel 114 through exit conduit 122. The temperature of slurry 117 is maintained at the desired temperature of at least 220° F., preferably from about 250° to about 550° F. and more preferably from about 300° to 500° F. by feeding a heating source, such as pressurized steam or other heating fluid, into jacket 123.

The superficial vapor velocity in the space immediately above slurry 117 should be kept within a range of from about 0.1 to about 0.3 ft/sec in order to avoid the carrying over of coal fines out of vessel 114. In addition, the average residence time for the coal in the vessel should range from about 10 to about 30 minutes.

By using the above-described drying vessel and method, it has been found that coal particulates can be dried efficiently without causing any problems with regard to foaming in the drying vessel.

The present invention is further illustrated by the following examples. However, it should be noted that the examples are merely for illustrative purposes and should not be construed to be limiting.

EXAMPLE 1

Wet ground Illinois No. 6 coal having an average particle size of 40–325 mesh (U.S. Sieve Series) was dried by heating in a hot hydrocarbon slurrying oil at atmospheric pressure. The oil was contained in a cylindrical vessel 3.37 in. inner diameter by 36 inch height, with the walls being heated by electric windings thermostatically controlled. The slurrying oil, which was derived from coal and had a normal boiling range of about 600°–950° F., was heated to the desired temperature and recirculated by a pump which withdrew the oil from the bottom of the vessel and returned it tangentially near the top so as to facilitate washdown of the coal. The wet coal was continuously added at the upper end of the vessel using a rotary feeder. The coal-oil slurry was also continuously stirred using a rotary stirrer with multiple blades; also a rotary blade was located in the vapor space. The vessel wall above the slurry liquid was maintained at essentially the same temperature as the slurry liquid. Net dried coal-oil slurry was withdrawn from the bottom end of the vessel at sufficient rate to maintain slurry level relatively constant and was analyzed for moisture content, while fresh slurry oil was added at the top. Vapor was withdrawn from the vessel and condensed in a water-cooled condenser. The moisture was rapidly removed from the coal in hot oil but any foam produced was quickly dissipated, as no foam was observed on the surface of the oil. Other results of these two coal drying tests are given below, and are plotted in FIG. 5.

| | Run 1 | Run 2 |
|---|---|---|
| Moisture in Coal Feed, W % | 9 | 6 |
| Slurry Oil Temperature, °F. | 350 | 500 |
| Coal Feed Rate, gm/hr | 310 | 550 |
| Slurry Oil Feed, gm/hr | 550 | 1230 |
| Slurry Oil/Coal Ratio | 1.77 | 2.24 |
| Slurry Recirculation Rate, gal/min | 3–5 | 3–5 |
| Coal Residence Time, min. | 0.2 approx. | 0.2 approx |
| Duration of Run, hrs. | 8 | 6.5 |
| Moisture in Coal-oil Slurry Withdrawn, W % | nil | nil |
| Condensed Hydrocarbon Vapor Evolved Boiling Range, °F. | | 200–586 |
| °API | | 10.9 |

EXAMPLE 2

Wet ground coal was dried in a hot recycled slurrying oil in the apparatus of FIG. 4 prior to use as feed to a coal hydrogenation process. Wyodak sub-bituminous coal containing about 30 weight percent moisture was ground to particle size smaller than about 30 mesh (0.0257 inch screen opening) and was initially surface dried using hot gas to about 15 weight percent moisture. This partially dried particulate coal was then fed into a slurry mix tank containing a hot recycled slurrying oil derived from the coal hydrogenation process and having a normal boiling temperature range of 500°-800° F. The coal-oil slurry was maintained at 200°-270° F. temperature by heating with circulating hot DOWTHERM liquid in an external heating jacket.

The slurry mixing tank capacity was about 200 gallons and was filled to 150 gallons, and its pressure was atmospheric. The following results were obtained.

| Test Period | 30 |
|---|---|
| Heating Jacket Temperature, °F. | 380 |
| Slurry Temperature, °F. | 228 |
| Wet Coal Feed Rate, Lb/Hr | 250 |
| Water in Coal Feed, Lb/Hr | 40.2 |
| Moisture Content of Coal Feed, W % | 16.1 |
| Water Removed by Tank Ventilation Air, Lb/Hr | 31.2 |
| Moisture in Coal Slurry Leaving Mix Tank, W % | 1.1 |
| Percent Moisture Removal Achieved in Slurry Mix Tank | 93 |
| Coal Residence Time in Slurry Mix Tank, Min. | 90 |

No noticeable foaming of the hot oil in the coal slurrying tank was encountered during the run. Results are plotted in FIG. 5.

Figure 5:
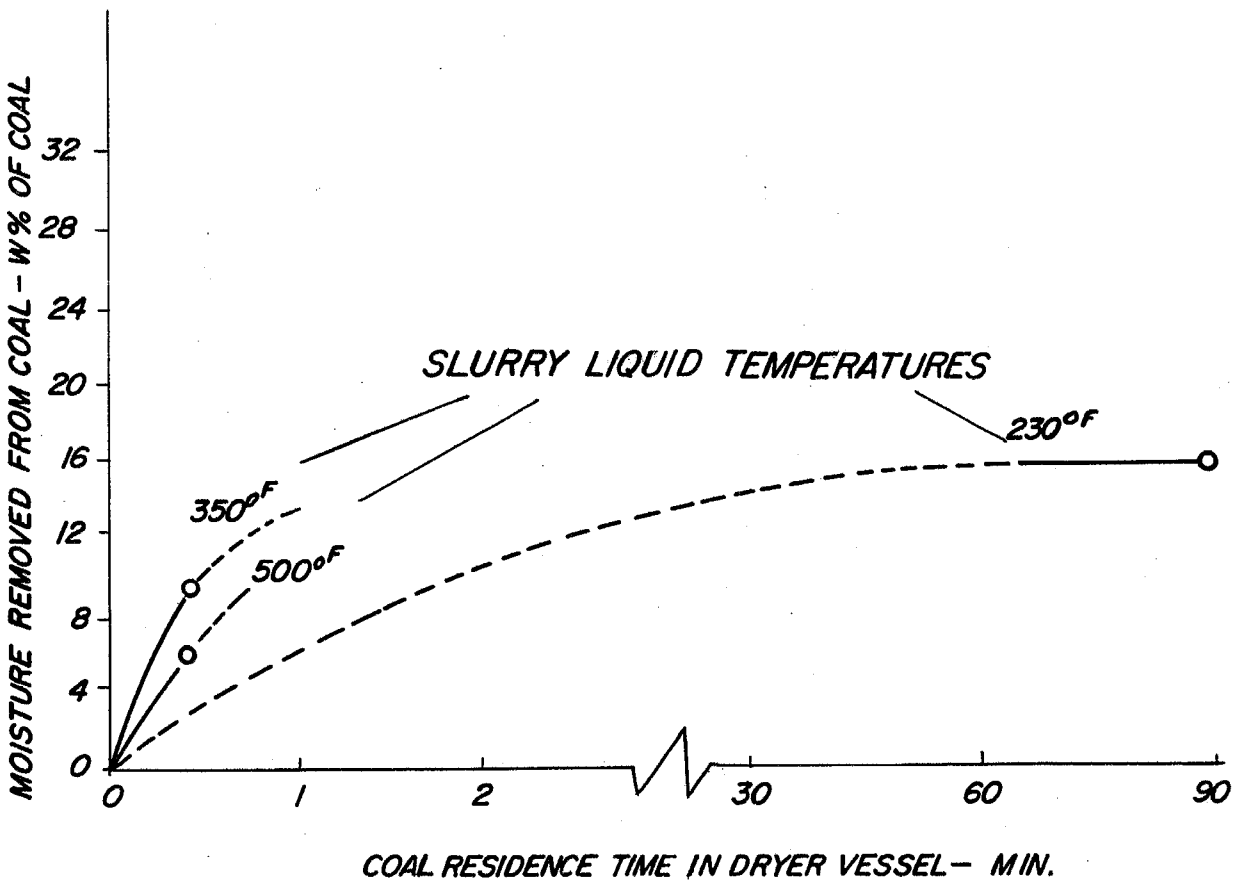
FIG. 5 is a graph showing a relationship between percent moisture removed from coal and its residence time in the dryer.

It will be noted from FIG. 5 that a generally direct relationship exists between the weight percent moisture removed from the coal feed and the coal residence times and slurry liquid temperatures used, with shorter residence times being required when higher slurry oil temperatures are used in the drying vessel.

Although this invention has been described with reference to certain preferred embodiments thereof, it will be understood that variations and modifications can be made within the spirit and scope of the invention, as described hereinabove and as defined by the appended claims.

What is claimed is:

1. A process for drying a moisture-containing particulate material comprising:

(a) maintaining a volume of hydrocarbon liquid, having a temperature of from about 200° F. to about 600° F. in the lower portion of a drying vessel, the upper portion of the vessel above the liquid surface forming a vapor zone for foam dissipation;

(b) feeding the particulates to the vessel at a point above the liquid level;

(c) maintaining the liquid-particulate slurry in the vessel in vertical flow by means of mechanical agitation;

(d) feeding a stream of hydrocarbon liquid having a temperature of from about 250° to about 550° F., to the vapor zone above the particulates, whereby the liquid and particulates are brought into intimate contact to prevent particulate entrainment by the flow of the vapor product and to wash the particulates into the liquid in the vessel;

(e) withdrawing from the bottom of the vessel a slurry-containing substantially dried particulates;

(f) withdrawing from the vapor zone a vapor product; and (g) condensing the vapor product to recover water and a hydrocarbon liquid.

2. The process of claim 1, wherein the vessel wall above the liquid level is heated to a temperature between about 300° F. to 600° F.

3. The process of claim 2, wherein the particulates comprise coal having from about 5% to 30% by weight moisture and a particle diameter smaller than 8 mesh in the U.S. Standard Sieve Series.

4. The process of claim 3, wherein a portion of slurry (f) is recycled and fed to the vessel at a point below the liquid level, the recycle stream being fed tangentially to the vessel.

5. The process of claim 4, wherein stream (d) has a normal boiling point of above about 500° F. and is a heavy hydrocarbon liquid produced in the liquefaction of coal.

6. The process of claim 5, wherein the particulate residence time in the vessel is less than 30 minutes and the upward vapor velocity immediately above the liquid surface is not more than about 0.3 ft/sec.

7. The process of claim 6, wherein the particulate material has a particle size of less than 8 mesh, U.S. Sieve Series; the hydrocarbon liquid in the vessel has a normal boiling temperature of above 500° F.; the average residence time for the particulates in the vessel is less than about 30 minutes; the upward vapor velocity immediately above the liquid surface is from about 0.1 to about 2.5 ft/sec; and the vessel wall above the liquid level is heated to from about 10° to about 50° F. above the temperature of the liquid in the vessel.

8. The process of claim 4, wherein a second portion of slurry (f) is recycled and fed to the vessel as stream (d) at a point above the particulate feed and below the foam breaking means.

9. The process of claim 8, wherein an additional stream of a heavy hydrocarbon liquid having a boiling point above 500° F. produced in the liquefaction of coal is fed to the vessel at a point below the liquid level.

10. The process of claim 9, wherein the second portion of slurry (f) is fed over a fluid distributor comprising a cone-shaped body having a circumferential weir projecting radially outward at the bottom portion thereof so as to form a continuous film of the slurry over the particulate feed.

11. The process of claim 10, wherein the particulate residence time in the vessel is less than about 25 minutes and the upward vapor velocity immediately above the liquid surface is not more than about 0.3 ft/sec.

12. The process of claim 11, wherein the particulate material has a particle size of less than 8 mesh, U.S. Sieve Series; the hydrocarbon liquid in the vessel has a normal boiling temperature of above 500° F.; the average residence time for the particulates in the vessel is less than about 30 minutes; the upward vapor velocity immediately above the liquid surface is from about 0.1 to about 2.5 ft/sec; and the vessel wall above the liquid level is heated to from about 10° to about 50° F. above the temperature of the liquid in the vessel.

13. The process of claim 11, wherein stream (d) is fed to the vessel at a point below the particulate feed.

14. The process of claim 13, wherein a first portion of slurry (f) is recycled and fed to the vapor zone and a second portion of slurry (f) is recycled and fed to the vessel as stream (d).

15. The process of claim 14, wherein the particulates comprise coal having from about 5% to 30% by weight moisture and a particle diameter smaller than 8 mesh in the U.S. Standard Sieve Series.

16. The process of claim 15, wherein the particulate residence time in the vessel is less than 30 minutes and the upward vapor velocity immediately above the liquid surface is not more than about 0.3 ft/sec.

17. The process of claim 16, wherein the particulate material has a particle size smaller than 8 mesh, U.S. Sieve Series; the hydrocarbon liquid in the vessel has a normal boiling temperature of above 500° F.; the average residence time for the particulates in the vessel is between 5 and 25 minutes; the upward vapor velocity immediately above the liquid surface is from about 0.1 to about 2.5 ft/sec; and the vessel wall above the liquid level is heated to from about 10° to about 50° F. above the temperature of the liquid in the vessel.

18. An apparatus for drying moisture-containing particulates comprising; a cylindrical vessel with two closed ends and having a vapor outlet near the top end thereof, a liquid outlet near the bottom end thereof, and an inlet for a particulate material, an inlet for a hot hydrocarbon liquid having a carbon liquid, all of the inlets being intermediate the vapor outlet and the liquid outlet, and a plurality of agitator means mounted on a cylindrical shaft which is connected to a rotary driving means, one of the agitator means being mounted in the top portion of the vessel and above the particulate feed.

19. The apparatus of claim 18, wherein a slurry distributor comprising a cone, having a circumferential weir projecting radially outward at the lower end thereof for forming a continuous film of slurry, is provided directly above the particulates inlet so as to prevent the particulates from being entrained by the upwardly moving vapor product in the vessel and to wash the particulates into the liquid.

20. An apparatus for drying a moisture-containing particulate material comprising a cylindrical vessel having a conical bottom portion, the vessel being provided with, at the top portion thereof, an outlet for vapor; a first inlet for a liquid; a second inlet for the particulate material, the second inlet comprising a tubular conduit, with the top end being connected to a screw-type conveyor and the bottom end connected to the top of the vessel, the conduit being provided, intermediate the top and bottom ends, a plurality of downwardly pointing connecting conduits arranged circumferentially and at equal distances, for introducing a hot hydrocarbon liquid, the longitudinal axis of the connecting conduits forming an angle of from about 15 to about 75 degrees with the longitudinal axis of the tubular conduit; in the bottom portion of the vessel a liquid outlet; and a plurality of agitating means mounted on a cylindrical shaft and driven by motor means, the shaft forming an angle of from about 4 to about 45 degrees with the vertical axis.

* * * * *